US008138977B2

(12) United States Patent
Zhang et al.

(10) Patent No.: US 8,138,977 B2
(45) Date of Patent: Mar. 20, 2012

(54) ANTENNAS FOR HANDHELD ELECTRONIC DEVICES

(75) Inventors: Zhijun Zhang, Santa Clara, CA (US); Fletcher R. Rothkopf, Mountain View, CA (US); Robert W. Schlub, Campbell, CA (US); Ruben Caballero, San Jose, CA (US)

(73) Assignee: Apple Inc., Cupertino, CA (US)

( * ) Notice: Subject to any disclaimer, the term of this patent is extended or adjusted under 35 U.S.C. 154(b) by 305 days.

(21) Appl. No.: 11/890,865

(22) Filed: Aug. 7, 2007

(65) Prior Publication Data

US 2009/0040115 A1 Feb. 12, 2009

(51) Int. Cl.
*H01Q 1/24* (2006.01)

(52) U.S. Cl. ..... 343/702; 343/872

(58) Field of Classification Search ..... 343/702, 343/872; 455/575.1, 575.7, 575.8
See application file for complete search history.

(56) References Cited

U.S. PATENT DOCUMENTS

| | | | | |
|---|---|---|---|---|
| 6,011,517 | A | 1/2000 | Skurski | |
| 6,054,955 | A | 4/2000 | Schlegel, Jr. et al. | |
| 6,348,894 | B1 | 2/2002 | Lahti | |
| 6,642,907 | B2 * | 11/2003 | Hamada et al. | 343/873 |
| 6,879,293 | B2 * | 4/2005 | Sato | 343/702 |
| 7,080,787 | B2 | 7/2006 | Wulff et al. | |
| 7,158,083 | B2 * | 1/2007 | Satoh et al. | 343/702 |
| 7,164,387 | B2 | 1/2007 | Sievenpiper | |
| 2003/0124985 | A1 | 7/2003 | Shin et al. | |
| 2004/0178957 | A1 | 9/2004 | Chang et al. | |
| 2004/0223004 | A1 | 11/2004 | Lincke et al. | |
| 2005/0017902 | A1 | 1/2005 | Oyama et al. | |
| 2006/0066490 | A1 | 3/2006 | Ku et al. | |
| 2007/0080865 | A1 * | 4/2007 | Huang et al. | 343/700 MS |
| 2007/0135181 | A1 | 6/2007 | Ohki et al. | |
| 2007/0296638 | A1 * | 12/2007 | Kim et al. | 343/702 |
| 2008/0001822 | A1 * | 1/2008 | Vesterinen | 343/700 MS |
| 2008/0048929 | A1 * | 2/2008 | Channabasappa | 343/895 |

FOREIGN PATENT DOCUMENTS

| | | | |
|---|---|---|---|
| CN | 1520131 | | 8/2004 |
| EP | 1 445 824 | A | 8/2004 |
| EP | 1 478 047 | A1 | 11/2004 |
| GB | 2 434 697 | A | 8/2007 |
| KR | 10 2007 047 383 | A | 5/2007 |
| WO | 03/044891 | A | 5/2003 |

* cited by examiner

*Primary Examiner* — Jacob Y Choi
*Assistant Examiner* — Robert Karacsony
(74) *Attorney, Agent, or Firm* — Treyz Law Group; G. Victor Treyz; Nancy Y. Ru

(57) ABSTRACT

Handheld electronic devices are provided that contain wireless communications circuitry. The wireless communications circuitry may include antenna structures. An antenna may be located in an upper right corner of the handheld device as the handheld device is operated in a portrait mode. When the handheld device is rotated counterclockwise and operated in a landscape mode, the antenna is located in an unobstructed upper left corner of the device. The antenna may be formed from a strip of conductor. A proximal end of the strip of conductor may be connected to a transmission line. A distal end of the strip of conductor may be routed away from housing surfaces by bends formed in the strip. A printed circuit board in the handheld electronic device may have a hole. The distal end of the strip of conductor may be located adjacent to the hole.

18 Claims, 17 Drawing Sheets

ANTENNAS FOR HANDHELD ELECTRONIC DEVICES

BACKGROUND

This invention relates generally to wireless communications circuitry, and more particularly, to wireless communications circuitry for handheld electronic devices.

Handheld electronic devices are becoming increasingly popular. Examples of handheld devices include handheld computers, cellular telephones, media players, and hybrid devices that include the functionality of multiple devices of this type.

Due in part to their mobile nature, handheld electronic devices are often provided with wireless communications capabilities. Handheld electronic devices may use long-range wireless communications to communicate with wireless base stations. For example, cellular telephones may communicate using cellular telephone bands at 850 MHz, 900 MHz, 1800 MHz, and 1900 MHz. Handheld electronic devices may also use short-range wireless communications links. For example, handheld electronic devices may communicate using the WiFi® (IEEE 802.11) band at 2.4 GHz and the Bluetooth® band at 2.4 GHz. Communications are also possible in data service bands such as the 3G data communications band at 2170 MHz band (commonly referred to as UMTS or Universal Mobile Telecommunications System).

To satisfy consumer demand for small form factor wireless devices, manufacturers are continually striving to reduce the size of components that are used in these devices. For example, manufacturers have made attempts to miniaturize the antennas used in handheld electronic devices.

A typical antenna may be fabricated by patterning a metal layer on a circuit board substrate or may be formed from a sheet of thin metal using a foil stamping process. Antennas such as planar inverted-F antennas (PIFAs) and antennas based on L-shaped resonating elements can be fabricated in this way. Antennas such as PIFA antennas and antennas with L-shaped resonating elements can be used in handheld devices.

Although modern handheld electronic devices often need to function over a number of different communications bands, it is difficult to design a compact antenna that covers all frequency bands of interest.

It would therefore be desirable to be able to provide improved antennas and wireless handheld electronic devices.

SUMMARY

Handheld electronic devices and antennas for handheld electronic devices are provided. A handheld electronic device may have a display. The handheld electronic device may have a conductive housing such as a metal housing. The display may be mounted to the front surface of the housing.

An antenna in the device may be formed from a ground plane element and a resonating element. The antenna resonating element may be mounted to a dielectric antenna resonating element support structure. The dielectric antenna resonating element support structure may have air-filled holes adjacent to the antenna resonating element.

The handheld electronic device may contain a printed circuit board having an air-filled hole. A transceiver circuit may be mounted to the printed circuit board. A transmission line may be used to connect the transceiver circuit to the antenna.

The antenna resonating element may be formed from a strip of conductor. One end of the strip of conductor may be connected to the transmission line. The other end of the strip of conductor may be located adjacent to the hole in the printed circuit board.

The handheld electronic device may be operated in a portrait mode and, when rotated a quarter of a turn counterclockwise, may be operated in a landscape mode. An opening may be formed in the upper right corner of the conductive housing of the handheld device when the handheld electronic device is in the portrait mode orientation. The antenna resonating element may be located within the opening. A dielectric cap may cover the antenna resonating element. The dielectric cap may lie flush with the conductive surfaces of the housing.

The antenna may be located in the upper right corner of the handheld device as viewed when the handheld device is operated in the portrait mode. When the handheld device is rotated counterclockwise and operated in the landscape mode, the antenna will be located in an unobstructed upper left corner of the device.

Further features of the invention, its nature and various advantages will be more apparent from the accompanying drawings and the following detailed description of the preferred embodiments.

DETAILED DESCRIPTION

The present invention relates generally to wireless communications, and more particularly, to wireless electronic devices and antennas for wireless electronic devices.

The wireless electronic devices may be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, which is sometimes described herein as an example, the portable electronic devices are handheld electronic devices.

The handheld devices may be, for example, cellular telephones, media players with wireless communications capabilities, handheld computers (also sometimes called personal digital assistants), remote controllers, global positioning system (GPS) devices, and handheld gaming devices. The handheld devices may also be hybrid devices that combine the functionality of multiple conventional devices. Examples of hybrid handheld devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

Figure 1:
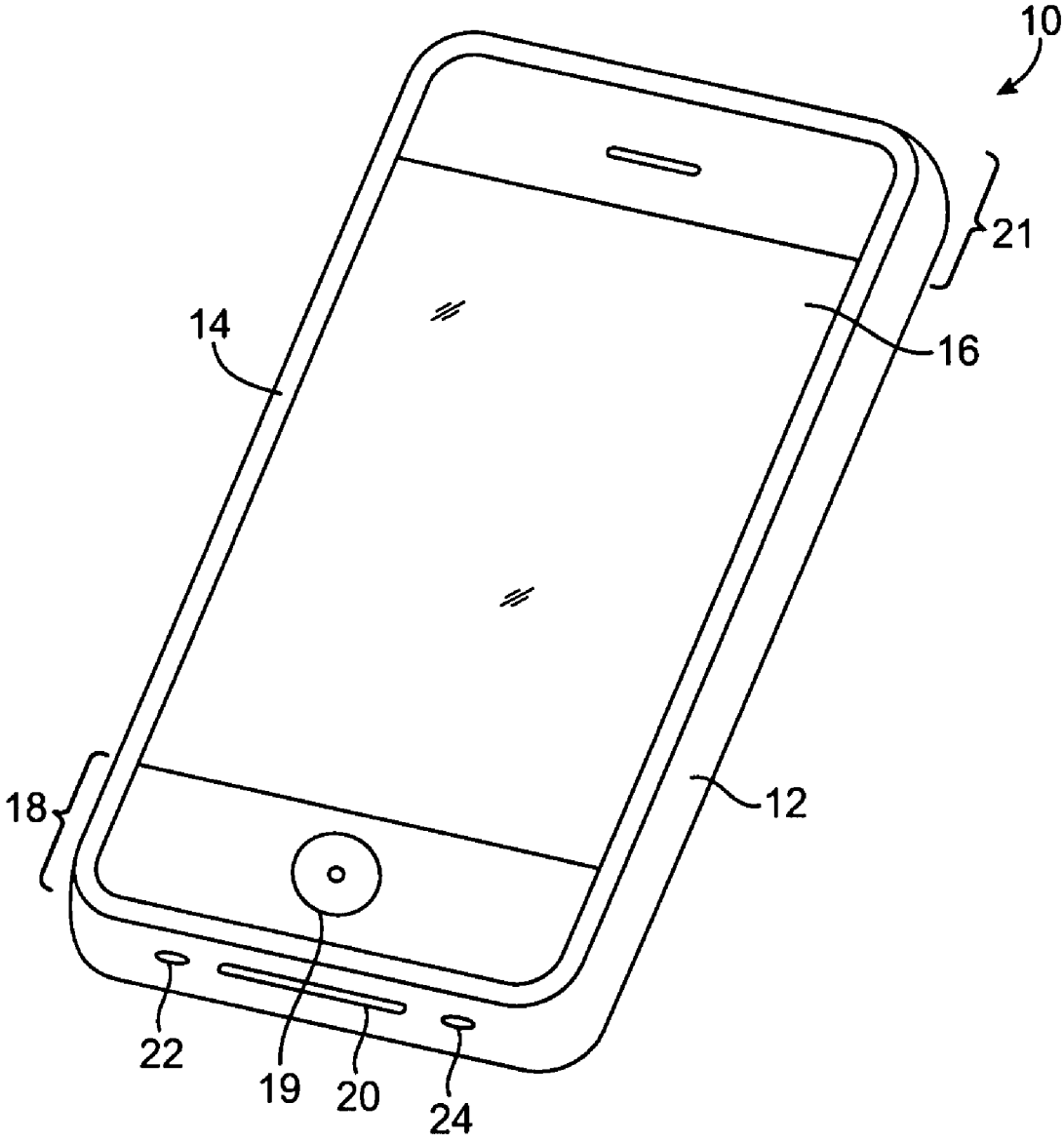
FIG. 1 is a perspective view of an illustrative handheld electronic device with an antenna in accordance with an embodiment of the present invention.

An illustrative handheld electronic device in accordance with an embodiment of the present invention is shown in FIG. 1. Device 10 may be any suitable portable or handheld electronic device.

Device 10 may have housing 12. Device 10 may include one or more antennas for handling wireless communications. Embodiments of device 10 that contain two antennas are sometimes described herein as an example.

Device 10 may handle communications over multiple communications bands. For example, wireless communications circuitry in device 10 may be used to handle cellular telephone communications in one or more frequency bands and data communications in one or more communications bands. With one suitable arrangement, which is sometimes described herein as an example, the wireless communications circuitry of device 10 uses a first antenna that is configured to handle communications in at least a first communications band and a second antenna that is configured to handle communications in at least a second communications band. The first antenna may, for example, handle communications in a communications band that is centered at 2.4 GHz or 5 GHz (e.g., WiFi and/or Bluetooth frequencies) or may handle Global Positioning Systems (GPS) communications at 1550 MHz or Universal Mobile Telecommunications System (UMTS) 3G data communications band at 2170 MHz (as examples). The second antenna may, for example, handle cellular telephone communications bands.

Housing 12, which is sometimes referred to as a case, may be formed of any suitable materials including, plastic, glass, ceramics, metal, or other suitable materials, or a combination of these materials. In some situations, housing 12 or portions of housing 12 may be formed from a dielectric or other low-conductivity material, so that the operation of conductive antenna elements that are located in proximity to housing 12 is not disrupted. Housing 12 or portions of housing 12 may also be formed from conductive materials such as metal. An illustrative housing material that may be used is anodized aluminum. Aluminum is relatively light in weight and, when anodized, has an attractive insulating and scratch-resistant surface. If desired, other metals can be used for the housing of device 10, such as stainless steel, magnesium, titanium, alloys of these metals and other metals, etc. In scenarios in which housing 12 is formed from metal elements, one or more of the metal elements may be used as part of the antenna in device 10. For example, metal portions of housing 12 may be shorted to an internal ground plane in device 10 to create a larger ground plane element for that device 10. To facilitate electrical contact between an anodized aluminum housing and other metal components in device 10, portions of the anodized surface layer of the anodized aluminum housing may be selectively removed during the manufacturing process (e.g., by laser etching).

Housing 12 may have a bezel 14. The bezel 14 may be formed from a conductive material. The conductive material may be a metal (e.g., an elemental metal or an alloy) or other suitable conductive materials. With one suitable arrangement, which is sometimes described herein as an example, bezel 14 may be formed from stainless steel. Stainless steel can be manufactured so that it has an attractive shiny appearance, is structurally strong, and does not corrode easily. If desired, other structures may be used to form bezel 14. For example, bezel 14 may be formed from plastic that is coated with a shiny coating of metal or other suitable substances.

Bezel 14 may serve to hold a display or other device with a planar surface in place on device 10. As shown in FIG. 1, for example, bezel 14 may be used to hold display 16 in place by attaching display 16 to housing 12. Device 10 may have front and rear planar surfaces. In the example of FIG. 1, display 16 is shown as being formed as part of the planar front surface of device 10. The periphery of the front surface may be surrounded by bezel 14. If desired, the periphery of the rear surface may be surrounded by a bezel (e.g., in a device with both front and rear displays).

Display 16 may be a liquid crystal diode (LCD) display, an organic light emitting diode (OLED) display, or any other suitable display. The outermost surface of display 16 may be formed from one or more plastic or glass layers. If desired, touch screen functionality may be integrated into display 16 or may be provided using a separate touch pad device. An advantage of integrating a touch screen into display 16 to make display 16 touch sensitive is that this type of arrangement can save space and reduce visual clutter.

In a typical arrangement, bezel 14 may have prongs that are used to secure bezel 14 to housing 12 and that are used to electrically connect bezel 14 to housing 12 and other conductive elements in device 10. The housing and other conductive elements form a ground plane for the antenna(s) in the handheld electronic device. A gasket (e.g., an o-ring formed from silicone or other compliant material, a polyester film gasket, etc.) may be placed between the underside of bezel 14 and the outermost surface of display 16. The gasket may help to relieve pressure from localized pressure points that might otherwise place stress on the glass or plastic cover of display 16. The gasket may also help to visually hide portions of the interior of device 10 and may help to prevent debris from entering device 10.

In addition to serving as a retaining structure for display 16, bezel 14 may serve as a rigid frame for device 10. In this capacity, bezel 14 may enhance the structural integrity of device 10. For example, bezel 14 may make device 10 more rigid along its length than would be possible if no bezel were used. Bezel 14 may also be used to improve the appearance of device 10. In configurations such as the one shown in FIG. 1 in which bezel 14 is formed around the periphery of a surface of device 10 (e.g., the periphery of the front face of device 10), bezel 14 may help to prevent damage to display 16 (e.g., by shielding display 16 from impact in the event that device 10 is dropped, etc.).

Display screen 16 (e.g., a touch screen) is merely one example of an input-output device that may be used with handheld electronic device 10. If desired, handheld electronic device 10 may have other input-output devices. For example, handheld electronic device 10 may have user input control devices such as button 19, and input-output components such as port 20 and one or more input-output jacks (e.g., for audio and/or video). Button 19 may be, for example, a menu button. Port 20 may contain a 30-pin data connector (as an example). Openings 24 and 22 may, if desired, form microphone and speaker ports. Display screen 16 may be, for example, a liquid crystal display (LCD), an organic light-emitting diode (OLED) display, a plasma display, or multiple displays that use one or more different display technologies. In the example of FIG. 1, display screen 16 is shown as being mounted on the front face of handheld electronic device 10, but display screen 16 may, if desired, be mounted on the rear face of handheld electronic device 10, on a side of device 10, on a flip-up portion of device 10 that is attached to a main body portion of device 10 by a hinge (for example), or using any other suitable mounting arrangement.

A user of handheld device 10 may supply input commands using user input interface devices such as button 19 and touch screen 16. Suitable user input interface devices for handheld electronic device 10 include buttons (e.g., alphanumeric keys, power on-off, power-on, power-off, and other specialized buttons, etc.), a touch pad, pointing stick, or other cursor control device, a microphone for supplying voice commands, or any other suitable interface for controlling device 10. Although shown schematically as being formed on the top face of handheld electronic device 10 in the example of FIG. 1, buttons such as button 19 and other user input interface devices may generally be formed on any suitable portion of handheld electronic device 10. For example, a button such as button 19 or other user interface control may be formed on the side of handheld electronic device 10. Buttons and other user interface controls can also be located on the top face, rear face, or other portion of device 10. If desired, device 10 can be controlled remotely (e.g., using an infrared remote control, a radio-frequency remote control such as a Bluetooth remote control, etc.).

Handheld device 10 may have ports such as port 20. Port 20, which may sometimes be referred to as a dock connector, 30-pin data port connector, input-output port, or bus connector, may be used as an input-output port (e.g., when connecting device 10 to a mating dock connected to a computer or other electronic device). Device 10 may also have audio and video jacks that allow device 10 to interface with external components. Typical ports include power jacks to recharge a battery within device 10 or to operate device 10 from a direct current (DC) power supply, data ports to exchange data with external components such as a personal computer or peripheral, audio-visual jacks to drive headphones, a monitor, or other external audio-video equipment, a subscriber identity module (SIM) card port to authorize cellular telephone service, a memory card slot, etc. The functions of some or all of these devices and the internal circuitry of handheld electronic device 10 can be controlled using input interface devices such as touch screen display 16.

Components such as display 16 and other user input interface devices may cover most of the available surface area on the front face of device 10 (as shown in the example of FIG. 1) or may occupy only a small portion of the front face of device 10. Because electronic components such as display 16 often contain large amounts of metal (e.g., as radio-frequency shielding), the location of these components relative to the antenna elements in device 10 should generally be taken into consideration. Suitably chosen locations for the antenna elements and electronic components of the device will allow the antennas of handheld electronic device 10 to function properly without being disrupted by the electronic components.

With one suitable arrangement, which is sometimes described herein as an example, handheld electronic device has two antennas. A first antenna may be located in the upper right corner of device 10 in region 21. A second antenna may be located in the lower end of device 10 in region 18.

The first antenna may be (for example), a WiFi antenna, a GPS antenna, a UMTS antenna, etc. The location of the first antenna in region 21 may help to ensure adequate antenna performance in the event that a user of device 10 uses device 10 in a landscape orientation (e.g., a landscape orientation in which button 19 is placed at the user's right and antenna region 21 is placed at the top of device 10).

The second antenna may be (for example) a cellular telephone antenna. An advantage of locating antenna resonating element structures for the second antenna in the lower portion of housing 12 and device 10 (i.e., in region 18) is that this places radiating portions of the antenna structures away from the user's head when the device 10 is held to the head (e.g., when talking into a microphone and listening to a speaker in the handheld device as with a cellular telephone). This reduces the amount of radio-frequency radiation that is emitted in the vicinity of the user. Placing the second antenna in region 18 may also help to reduce proximity effects (i.e., influences on the performance of the second antenna due to the proximity of the second antenna to portions of the user's body).

It may also be desirable to minimize proximity effects for the first antenna, particularly when the first antenna is used in a handheld electronic device having a conductive housing. When handheld electronic device 10 has conductive housing walls, it may be necessary to locate the antenna resonating element for the first antenna within a few millimeters of the conductive housing walls. This reduces antenna bandwidth.

When an antenna has a narrow bandwidth, it may be particularly sensitive to detuning due to proximity effects.

To minimize proximity effects for the first antenna, the resonating element for the first antenna may be configured so that its tail (its distal end), which may be particularly sensitive to proximity effects, is not immediately adjacent to the surface of housing 12. Routing the tail of the antenna resonating element away from the surfaces of housing 12 in this way helps to prevent situations in which a user's body (e.g., the user's fingers, hands, or face) come into close proximity to the tail, thereby reducing or eliminating proximity effects.

Figure 2:
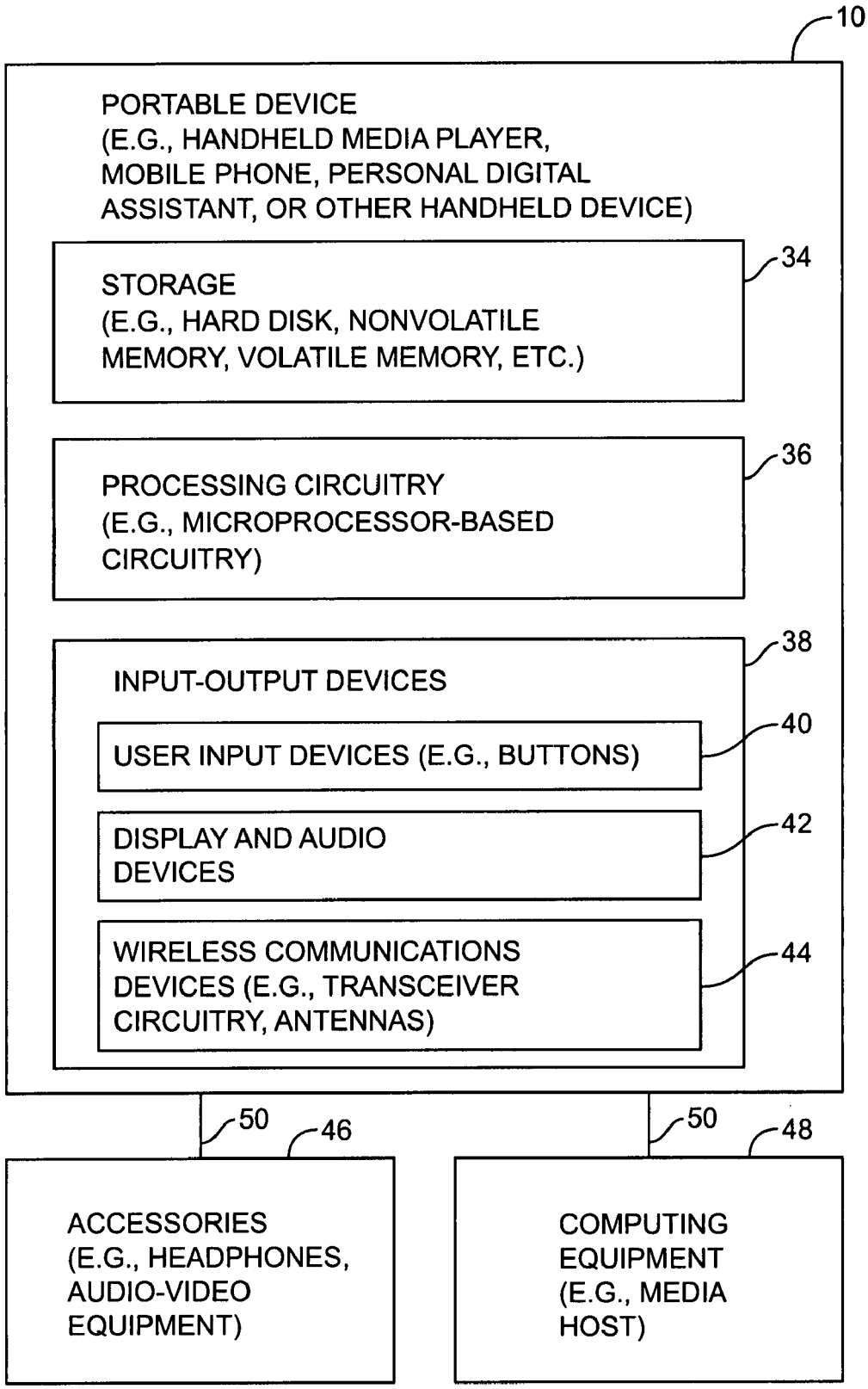
FIG. 2 is a schematic diagram of an illustrative handheld electronic device with an antenna in accordance with an embodiment of the present invention.

A schematic diagram of an embodiment of an illustrative handheld electronic device is shown in FIG. 2. Handheld device 10 may be a mobile telephone, a mobile telephone with media player capabilities, a handheld computer, a remote control, a game player, a global positioning system (GPS) device, a combination of such devices, or any other suitable portable electronic device.

As shown in FIG. 2, handheld device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as WiFi®), protocols for other short-range wireless communications links such as the Bluetooth® protocol, protocols for handling 3G data services such as UMTS, cellular telephone communications protocols, etc.

Input-output devices 38 may be used to allow data to be supplied to device 10 and to allow data to be provided from device 10 to external devices. Display screen 16, button 19, microphone port 24, speaker port 22, and dock connector port 20 are examples of input-output devices 38.

Input-output devices 38 can include user input-output devices 40 such as buttons, touch screens, joysticks, click wheels, scrolling wheels, touch pads, key pads, keyboards, microphones, cameras, etc. A user can control the operation of device 10 by supplying commands through user input devices 40. Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, one or more antennas, and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content).

Computing equipment 48 may be any suitable computer. With one suitable arrangement, computing equipment 48 is a computer that has an associated wireless access point (router) or an internal or external wireless card that establishes a wireless connection with device 10. The computer may be a server (e.g., an internet server), a local area network computer with or without internet access, a user's own personal computer, a peer device (e.g., another handheld electronic device 10), or any other suitable computing equipment.

The antenna structures and wireless communications devices of device 10 may support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3G data communications band at 2170 MHz band (commonly referred to as UMTS or Universal Mobile Telecommunications System), the WiFi® (IEEE 802.11) bands at 2.4 GHz and 5.0 GHz (also sometimes referred to as wireless local area network or WLAN bands), the Bluetooth® band at 2.4 GHz, and the global positioning system (GPS) band at 1550 MHz. The 850 MHz band is sometimes referred to as the Global System for Mobile (GSM) communications band. The 900 MHz communications band is sometimes referred to as the Extended GSM (EGSM) band. The 1800 MHz band is sometimes referred to as the Digital Cellular System (DCS) band. The 1900 MHz band is sometimes referred to as the Personal Communications Service (PCS) band.

Device 10 can cover these communications bands and/or other suitable communications bands with proper configuration of the antenna structures in wireless communications circuitry 44.

Figure 3A:
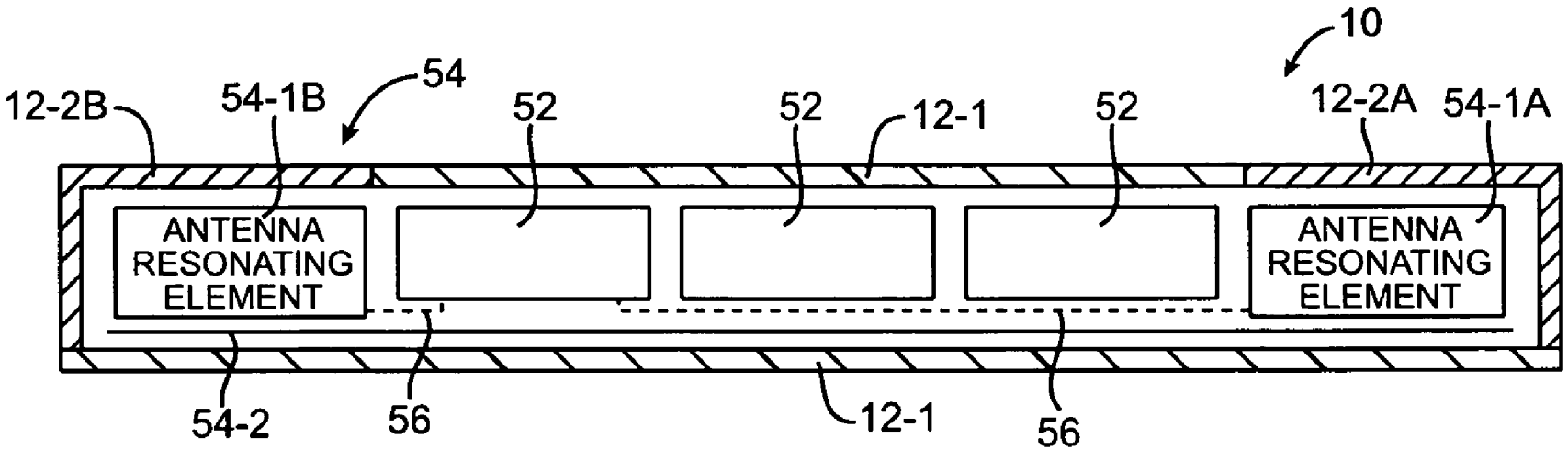
FIG. 3A is a cross-sectional side view of an illustrative handheld electronic device with an antenna structure and an additional antenna in accordance with an embodiment of the present invention.

A cross-sectional view of an illustrative handheld electronic device is shown in FIG. 3A. In the example of FIG. 3A, device 10 has a housing that is formed of a conductive portion 12-1 and dielectric portions 12-2A and 12-2B (e.g., portions 12-2A and 12-2B that are formed from plastic). Conductive portion 12-1 may be any suitable conductor such as aluminum, magnesium, stainless steel, alloys of these metals and other metals, etc. Conductive portion 12-1 may include a substantially rectangular conductive rear housing surface and housing side walls. Dielectric portions 12-2A and 12-2B may serve as caps that cover antennas that are mounted within housing 12. With one suitable arrangement, dielectric portions 12-2A and 12-2B may lie flush with the exterior surfaces of housing 12 (i.e., with the rear surface and sidewall surfaces of conductive housing portion 12-1).

There are two antennas in the example of FIG. 3A. A first of the two antennas is formed from antenna resonating element 54-1B and antenna ground plane 54-2. A second of the two antennas is formed from antenna resonating element 54-1A and ground plane 54-2. The first antenna (depicted as antenna 54 in FIG. 3A) may be formed from an elongated resonating element such as strip of stamped conductor or a trace on a flex circuit. The resonating element of the first antenna may have a first (proximal) end and a second (distal) end. The first end of the first antenna's resonating element may be fed by an antenna feed terminal in the vicinity of ground plane 54-2. The second end of the first antenna's resonating element, which is sometimes referred to as its tail, may be positioned in a location that is relatively insensitive to proximity effects. For example, the tail of the first antenna's resonating element may be mounted in a location in the interior of device 10 so that the tail is not immediately adjacent to the surface of housing portion 12-2B. This helps to minimize proximity effects by ensuring that the tail of the first antenna's resonating element cannot be contacted by a portion of a user's body.

Housing portions 12-2A and 12-2B may be formed from a dielectric. An advantage of using dielectric for housing portions 12-2A and 12-2B is that this allows resonating element portion 54-1 of antenna 54 of device 10 to operate without interference from the metal sidewalls of housing 12. With one suitable arrangement, housing portions 12-2A and 12-2B are plastic caps formed from a plastic based on acrylonitrile-butadiene-styrene copolymers (sometimes referred to as ABS plastic). These are merely illustrative housing materials for device 10. For example, the housing of device 10 may be formed substantially from plastic or other dielectrics, substantially from metal or other conductors, or from any other suitable materials or combinations of materials.

Components such as components 52 may be mounted on circuit boards in device 10. The circuit board structures in device 10 may be formed from any suitable materials. Suitable circuit board materials include paper impregnated with phonolic resin, resins reinforced with glass fibers such as fiberglass mat impregnated with epoxy resin (sometimes referred to as FR-4), plastics, polytetrafluoroethylene, polystyrene, polyimide, and ceramics. Circuit boards fabricated from materials such as FR-4 are commonly available, are not cost-prohibitive, and can be fabricated with multiple layers of metal (e.g., four layers). So-called flex circuits, which are flexible circuit board materials such as polyimide, may also be used in device 10.

Typical components in device 10 include integrated circuits, LCD screens, and user input interface buttons. Device 10 also typically includes a battery, which may be mounted along the rear face of housing 12 (as an example).

Because of the conductive nature of components such as these and the printed circuit boards upon which these components are mounted, the components, circuit boards, and conductive housing portions (including bezel 14) of device 10 may be grounded together to form antenna ground plane 54-2. With one illustrative arrangement, ground plane 54-2 may conform to the generally rectangular shape of housing 12 and device 10 and may match the rectangular lateral dimensions of housing 12.

Ground plane element 54-2 and antenna resonating element 54-1B may form first antenna 54 for device 10. Optional additional antennas such as the antenna formed from antenna resonating element 54-1A and ground plane 54-2 may, if desired, be configured to provide additional gain for an overlapping frequency band of interest (i.e., a band at which antenna 54 is operating) or may be used to provide coverage in a different frequency band of interest (i.e., a band outside of the range of antenna 54).

Any suitable conductive materials may be used to form ground plane element 54-2 and resonating elements 54-1A and 54-1B. Examples of suitable conductive materials for the antenna structures in device 10 include elemental metals, such as copper, silver, and gold, and metal alloys (e.g., beryllium copper). Conductors other than metals may also be used, if desired. In a typical scenario, the conductive structures for resonating element 54-1A are formed from copper traces on a flex circuit or other suitable substrate and the conductive structures for resonating element 54-1B are formed from a strip of beryllium copper foil.

Components 52 include transceiver circuitry (see, e.g., devices 44 of FIG. 2). The transceiver circuitry may be provided in the form of one or more integrated circuits and associated discrete components (e.g., filtering components). The transceiver circuitry may include one or more transmitter integrated circuits, one or more receiver integrated circuits, switching circuitry, amplifiers, etc. Each transceiver in the transceiver circuitry may have an associated coaxial cable, microstrip transmission line, or other transmission line that is connected to an associated antenna and over which radio frequency signals are conveyed. In the example of FIG. 3A, transmission lines are depicted by dashed line 56.

As shown in FIG. 3A, transmission lines 56 may be used to distribute radio-frequency signals that are to be transmitted through the antennas from a transmitter integrated circuit 52. Paths 56 may also be used to convey radio-frequency signals that have been received by an antenna to components 52. Components 52 may include one or more receiver integrated circuits for processing incoming radio-frequency signals.

Figure 3B:
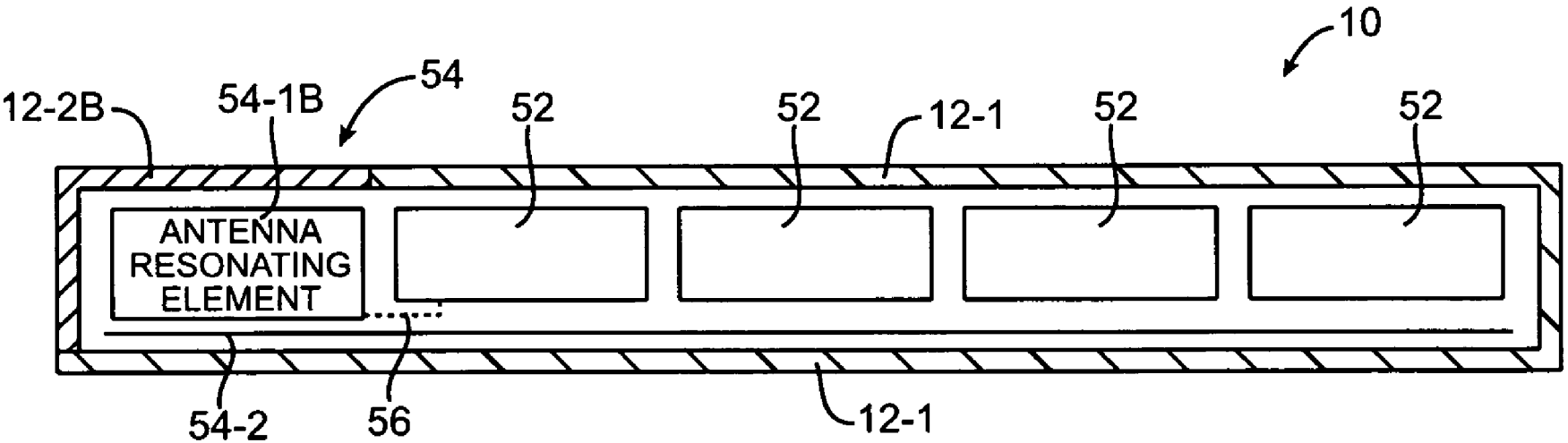
FIG. 3B is a cross-sectional side view of an illustrative handheld electronic device with an antenna structure in accordance with an embodiment of the present invention.

As shown in the cross-sectional diagram of FIG. 3A, it may be advantageous to locate the antennas in device 10 near the extremities of device 10 (i.e., at either end of device 10). If desired, the optional additional antenna formed from antenna resonating element 54-1A and ground plane 54-2 may be omitted. This type of arrangement is shown in the cross-sectional diagram of FIG. 3B. As shown in FIG. 3B, when optional additional antennas are omitted from device 10, there is additional area available for components 52.

Figure 4A:
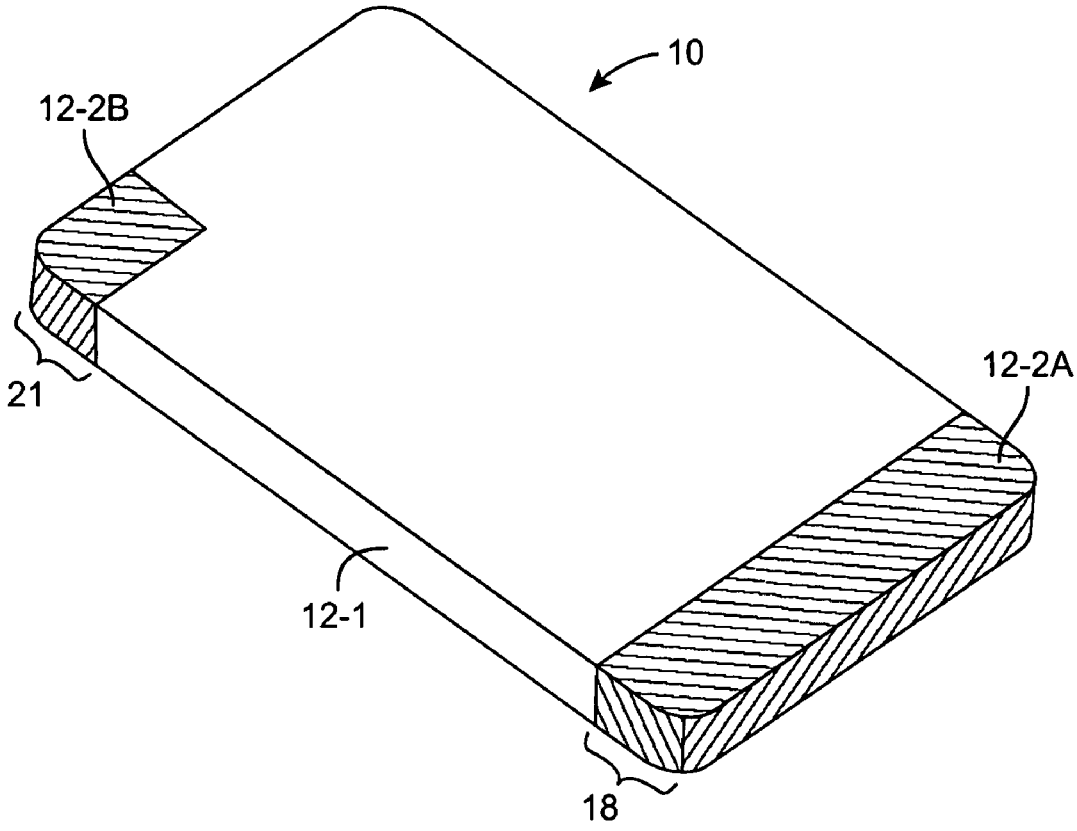
FIG. 4A is a perspective rear view of an illustrative handheld electronic device with antennas in accordance with an embodiment of the present invention.

An illustrative arrangement for handheld electronic device 10 in an embodiment with multiple antennas located near the extremities of device 10 is shown in FIG. 4A. In the arrangement of FIG. 4A, antennas may be located in locations 18 and 21. FIG. 4A is a perspective view of handheld electronic device 10. In the orientation of FIG. 4A, the rear surface of housing 12-1 is shown. The first antenna resonating element may be located in region 21 beneath dielectric housing portion 12-2B.

The second antenna resonating element may be located in region 18 beneath dielectric housing portion 12-2A. Dielectric housing portions 12-2A and 12-2B may be plastic caps formed from a suitable material such as ABS plastic (as an example). In the illustrative arrangement of FIG. 4A, cap 12-2A extends across the full width of device 10, whereas cap 12-2B is located in a corner of device 10. This type of arrangement may be particularly suitable in situations in which cap 12-2A is used to enclose an antenna that is used for cellular telephone communications and in which cap 12-2B is used to enclose an antenna that is used for higher-frequency data communications (e.g., WiFi communications at 2.4 GHz). Higher frequency communications bands such as the 2.4 GHz and 5 GHz bands are associated with radio frequency signals with shorter wavelengths, so somewhat more compact antenna arrangements may be used.

In situations in which housing 12-1 is formed from a conductive material (e.g., a metal such as aluminum or stainless steel), it may be desirable to position antenna cap 12-2B in a corner of device 10 (as shown in FIG. 4A), rather than positioning antenna cap 12-2B midway along one of the sides of device 10. This is because an antenna resonating element that is located in a corner position is less likely to be adversely affected by its proximity to conductive housing portions than an antenna resonating element that is located along one of the edges of device 10. In a central edge location, the antenna resonating element is effectively surrounded by metal on three sides, whereas the antenna resonating element is only surrounded by metal on two sides when the antenna resonating element and cap 12-2B are located on a corner of device 10 as shown in FIG. 4A.

If desired, device 10 may not contain antennas in region 18. A perspective rear view of handheld electronic device 10 in an embodiment in which there are no antennas in region 18 is shown in FIG. 4B.

Figure 5A:
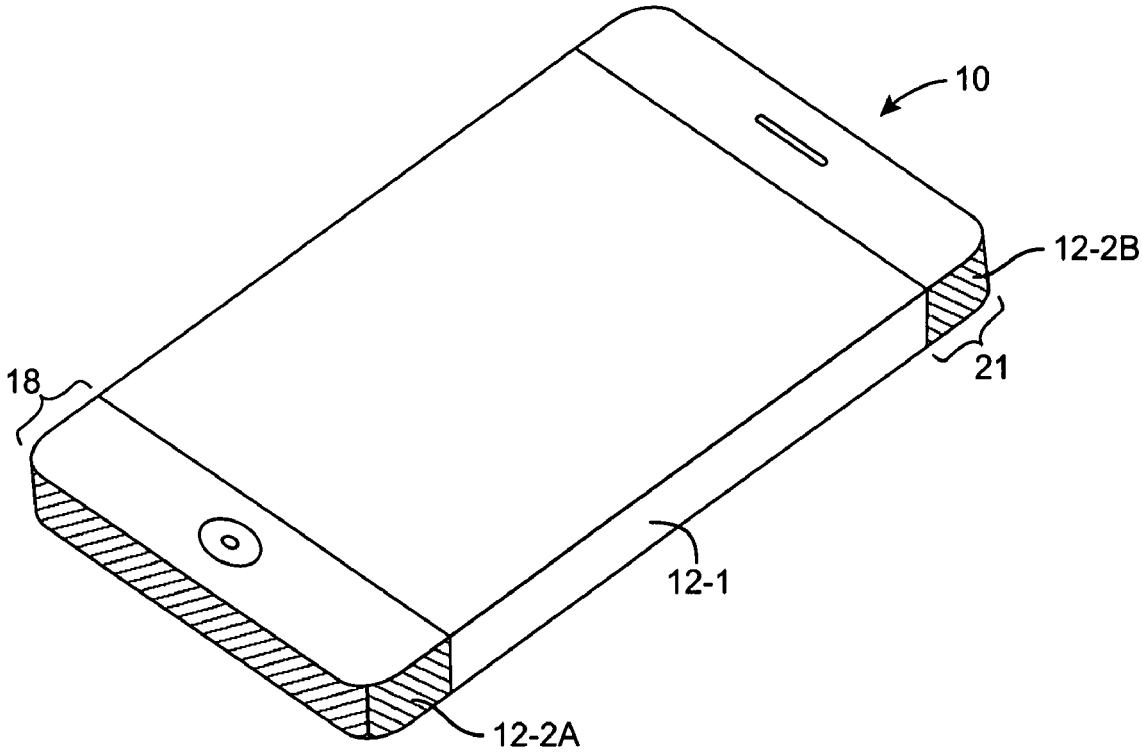
FIG. 5A is a perspective front view of an illustrative handheld electronic device with antennas in accordance with an embodiment of the present invention.

A perspective view of the illustrative handheld electronic device of FIG. 4A as viewed from the front side of the device is shown in FIG. 5A. As shown in FIG. 5A, the first antenna and dielectric cap 12-2B may be located in the upper right corner of device 10 when device 10 is held in a normal portrait orientation.

Figure 4B:
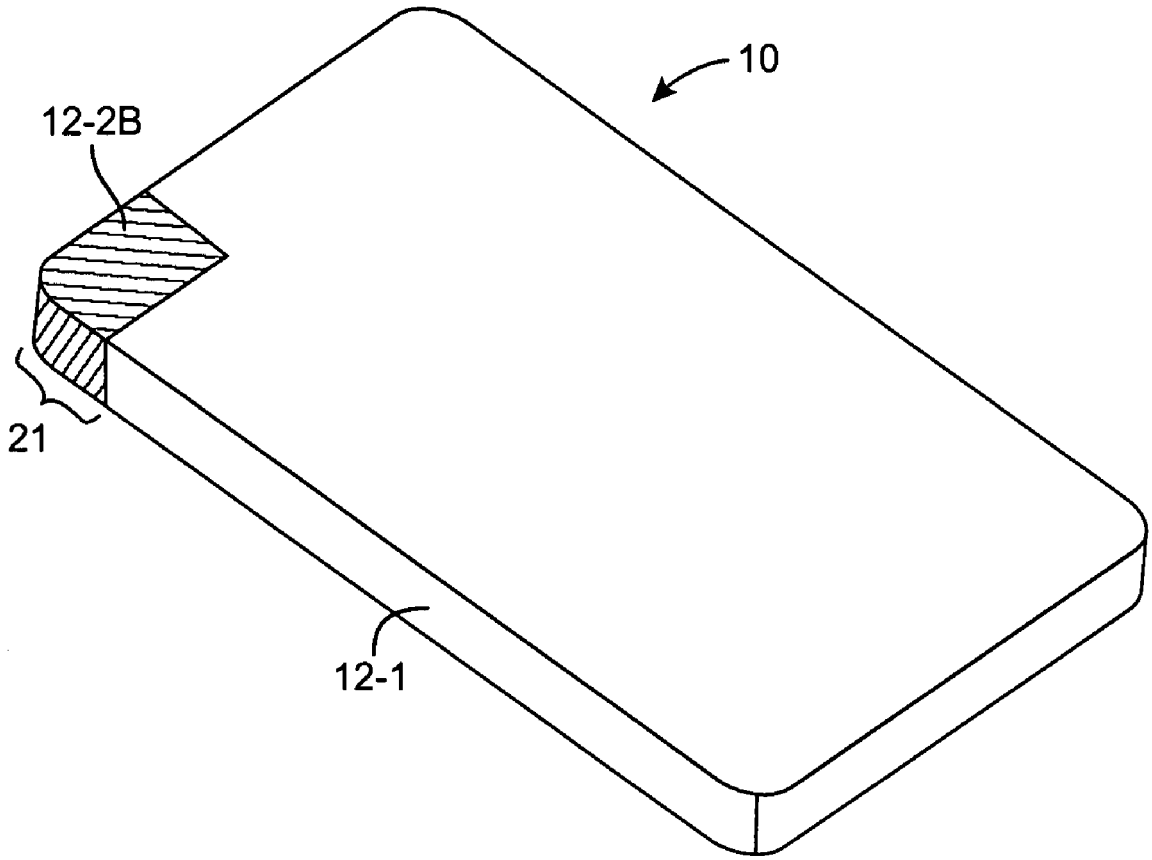
FIG. 4B is a perspective rear view of an illustrative handheld electronic device with an antenna in accordance with an embodiment of the present invention.
Figure 5B:
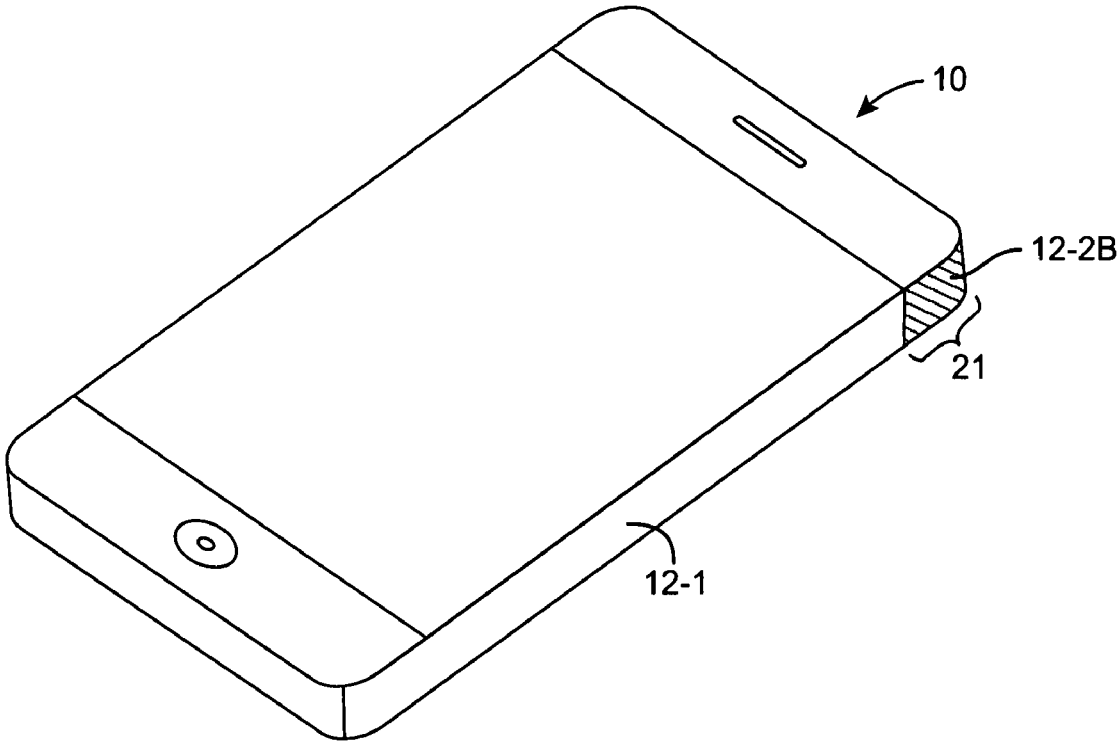
FIG. 5B is a perspective front view of an illustrative handheld electronic device with an antenna in accordance with an embodiment of the present invention.

A perspective view of the illustrative handheld electronic device of FIG. 4B as viewed from the front side of the device is shown in FIG. 5B. As with the multiple antenna embodiment of FIGS. 3A, 4A, and 5A, the single antenna embodiment of FIGS. 3B, 4B, and 5B may use a configuration in which antenna 54 and dielectric cap 12-2B are located in the upper right corner of device 10 when device 10 is held in a normal portrait orientation.

If desired, handheld electronic device 10 may be operated in both portrait and landscape orientations. For example, device 10 may contain position sensors (e.g., motion sensors). The processing circuitry in device 10 can monitor the signals from the position sensors to determine when device 10 is being used in portrait mode and when device 10 is being used in landscape mode. The user may also manually switch between portrait and landscape modes. The portrait mode orientation may be used for some applications (e.g., web browsing), whereas the landscape mode orientation may be used for other applications (e.g., video viewing).

In devices 10 that can be operated in either landscape or portrait orientations, it may be particularly advantageous to position antenna 54 and its associated dielectric cover 12-2B in the upper right corner of the device. This is illustrated in connection with FIGS. 6 and 7.

Figure 6:
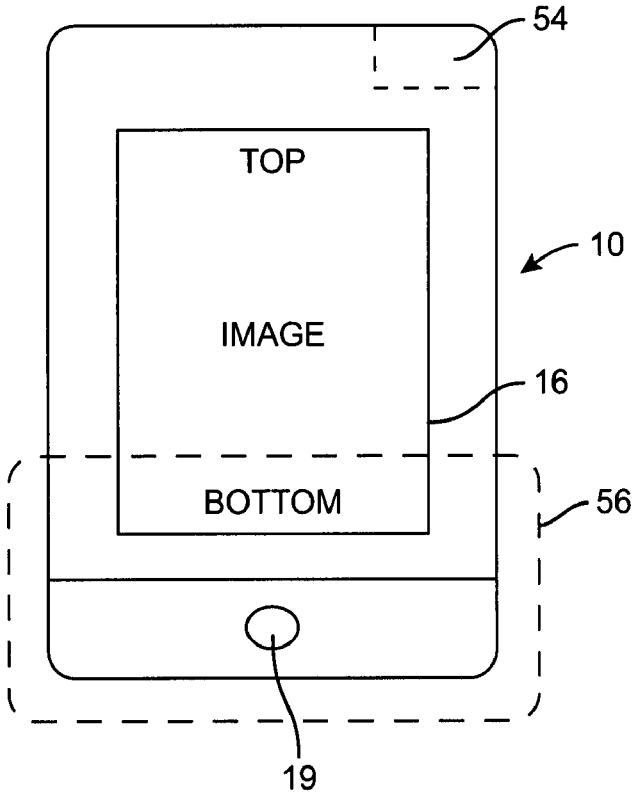
FIG. 6 is a front view of an illustrative handheld electronic device showing an illustrative antenna location when the handheld electronic device is held in its normal portrait orientation in accordance with an embodiment of the present invention.

In FIG. 6, device 10 is shown in its normal portrait mode orientation. In this orientation, button 19 is located at the bottom of device 10. Images that are displayed on display 16 may be oriented so that their upper portions are located at the top of display 16 and their lower portions are located at the bottom of display 16. The images that are displayed in this way may include text, still images, video, etc. The hands and fingers of a user are typically used to grip device 10 in region 56. Region 56 is generally located in the lower half or lower third of device 10. Because contact between the user and device 10 in region 56 may lead to proximity effects, it is desirable to locate antenna 54 in a region of device 10 other than region 56 (i.e., in the upper right corner of device 10).

Figure 7:
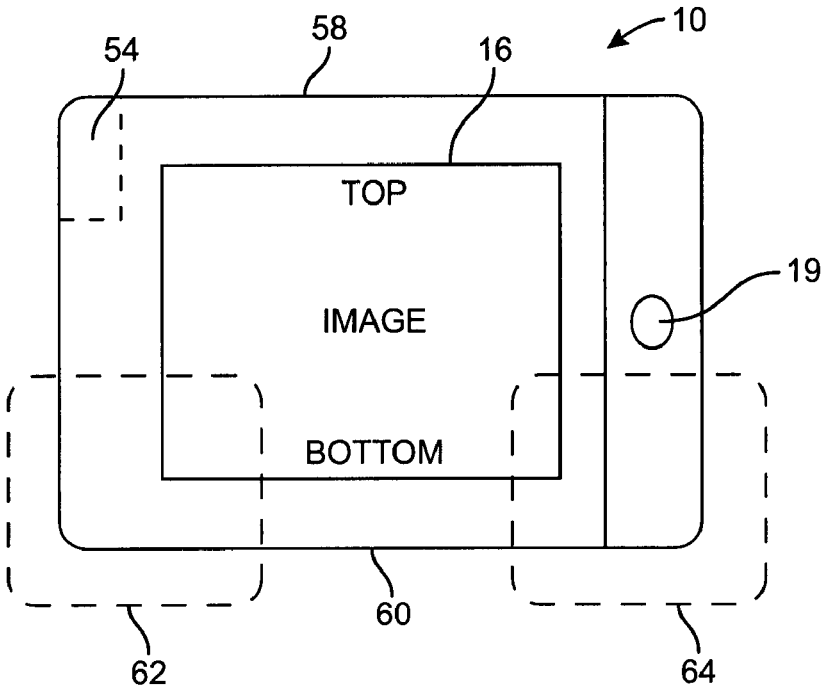
FIG. 7 is a front view of an illustrative handheld electronic device showing an illustrative antenna location when the handheld electronic device is held in its normal landscape orientation in accordance with an embodiment of the present invention.

When it is desired to use device 10 in its landscape mode, a user can rotate device 10 a quarter of a turn (90°) in the counterclockwise direction, as shown in FIG. 7. In this orientation, images that are displayed on display 16 have their upper portions located along right-hand edge 58 of device 10 (which is the top edge of device 10 in its landscape orientation) and have their lower portions located along left-hand edge 60 of device 10 (which is the bottom edge of device 10 in its landscape orientation). Because device 10 has been turned sideways relative to its normal portrait orientation, antenna 54 is located in the upper left corner of device 10 (as viewed in the landscape orientation). During use, a user's fingers may grip device 10 in regions such as regions 62 and 64. The normal regions for holding device such as regions 62 and 64 are generally located in the lower half or lower third of device 10 (as viewed in the landscape orientation).

As shown in FIGS. 6 and 7, it is unlikely that a user will place a finger directly over antenna 54 when holding device 10 during normal operation, because the common regions for holding device 10 in both the portrait and landscape modes (i.e., region 56 of FIG. 6 and regions 62 and 64 of FIG. 7) do not overlap antenna 54. As a result, proximity effects that might adversely affect the performance of antenna 54 are generally avoided. Antenna configurations in which the antenna is placed in the upper right corner of the device (as shown in FIG. 6) may be used with any suitable type of antenna. The upper right corner configuration is particularly desirable in situations in which the antenna is sensitive to proximity effects. For example, the upper right corner configuration may be advantageous in arrangements in which a metal case is in close proximity to the antenna resonating element, as this tends to decrease antenna bandwidth and make the antenna more sensitive to proximity effects.

Figure 8:
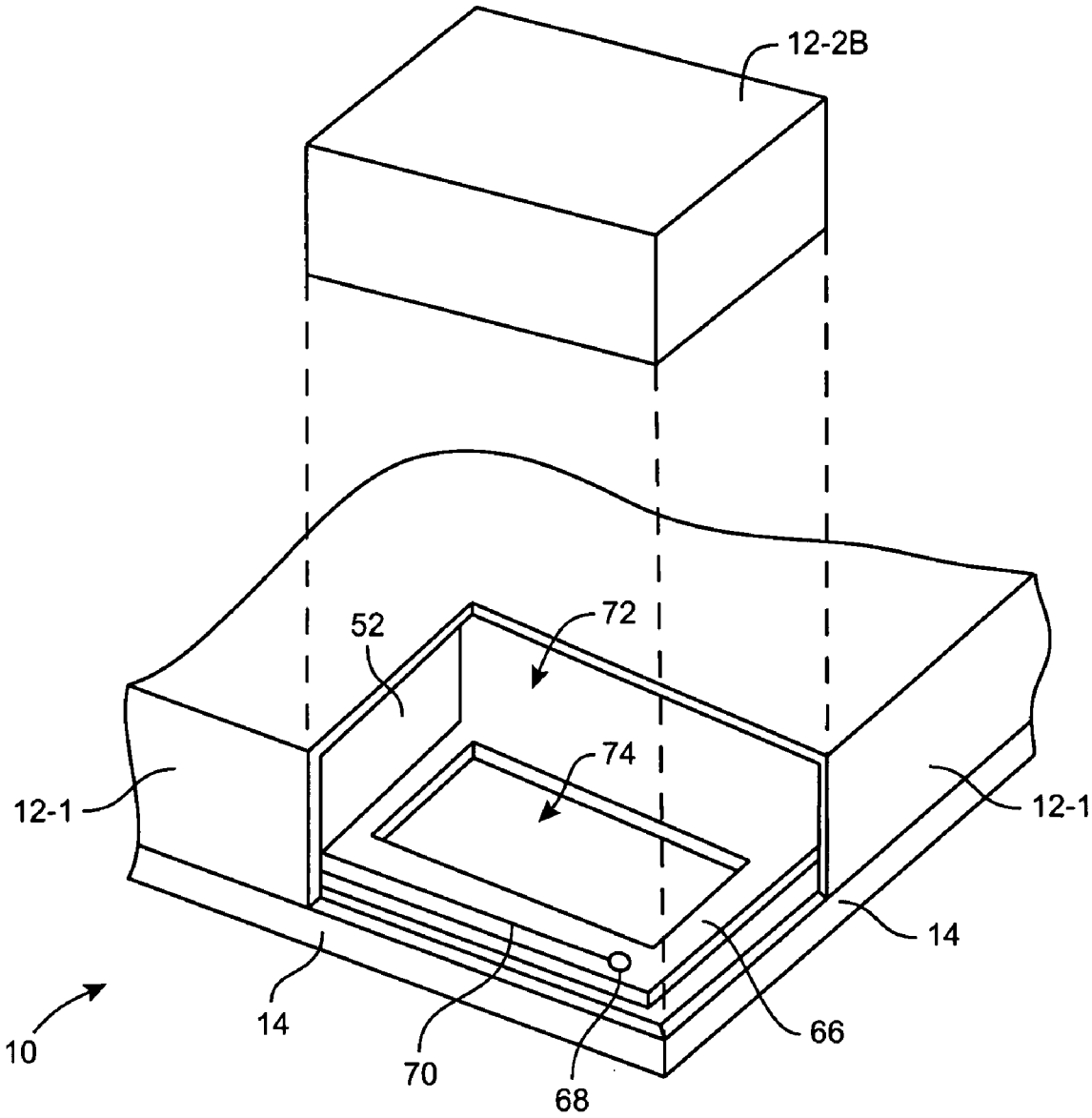
FIG. 8 is a perspective view of a corner portion of an illustrative handheld electronic device having an antenna in accordance with an embodiment of the present invention.

A perspective view of structures associated with an antenna in the upper right corner of device 10 is shown in FIG. 8. As shown in FIG. 8, dielectric cap 12-2B may be used to cover an opening (removed portion) of conductive housing walls 12-1. In the orientation of FIG. 8, the front of device 10 faces downwards and the rear of device 10 faces upwards. A circuit board or other mounting structure 66 may be located near the front side of device 10. Circuit board 66 may, for example, be mounted on a metal frame within housing 12. Bezel 14 may extend around the outer periphery of device 10. A hole such as hole 74 may be formed in circuit board 66. Bezel 14 may extend around the hole 74.

An antenna resonating element for antenna 54 (i.e., antenna resonating element 54-1B) may be located within the area formed by the removed portions of sidewalls 12-1 and in the air-filled opening formed by the removed portion of circuit board 66. Antenna resonating element 54-1B (not shown in FIG. 8) may be formed from a strip of conductor. One end of the strip of conductor may make electrical contact to contact pad 68. The other end of the strip (which is sometimes referred to as the tail of the resonating element) may be placed in a location within the middle of the opening 72. The tail of antenna resonating element 54-1B is generally the most sensitive portion of antenna 54 to proximity effects. Accordingly, it is desirable to locate the tail of the antenna away from the surface of housing 12 (i.e., the outer surfaces of dielectric housing member 12-2B). In such outer surface locations, antenna 54 might be detuned if the user touched dielectric cover 12-2B.

Transceiver 52 may be electrically connected to contact pad 68 (and therefore antenna resonating element 54-1B) by a transmission line. The transmission line may be formed from a coaxial cable or any other suitable transmission line structure. In the illustrative arrangement shown in FIG. 8, the transmission line for connecting transceiver 52 to antenna resonating element 54-1B is a microstrip transmission line. The microstrip transmission line has two conductors. One conductor in the microstrip transmission line is a ground plane conductor (e.g., a conductor formed from a metal layer on the lower surface of printed circuit board 66 as viewed in FIG. 8). The other conductor in the microstrip transmission line is a signal conductor such as signal conductor 70.

Figure 9:
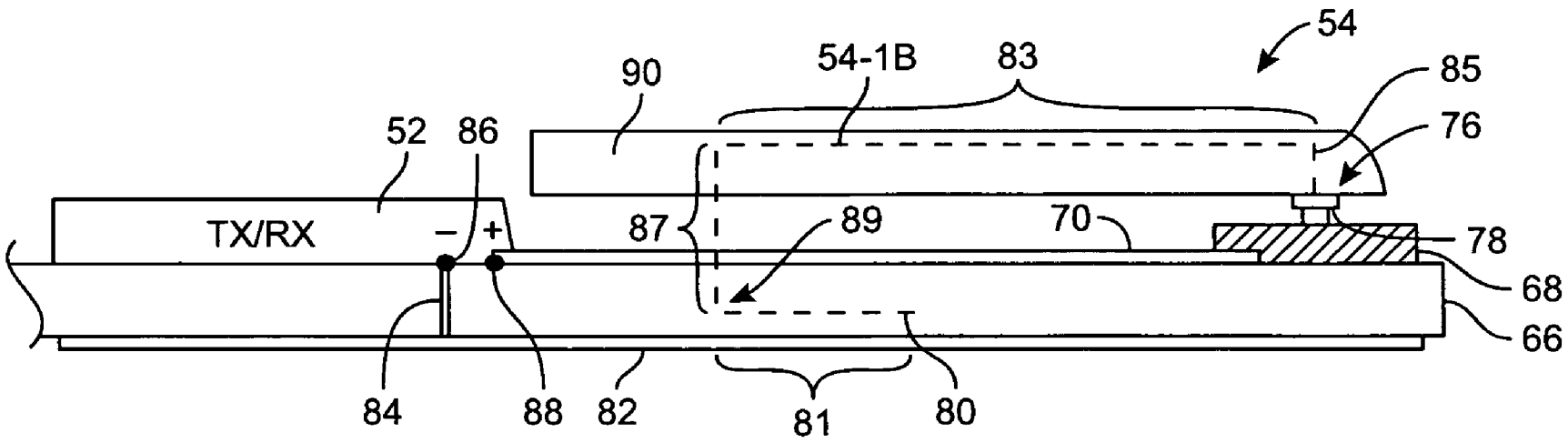
FIG. 9 is a side interior view of a corner portion of an illustrative handheld electronic device in accordance with an embodiment of the present invention.

A side view of device 10 in the vicinity of antenna 54 is shown in FIG. 9. As shown in FIG. 9, ground conductor 82 may form one part of the microstrip transmission line and signal conductor 70 may form another part of the microstrip transmission line. The microstrip transmission line may be used to electrically connect transceiver 52 and antenna resonating element 54-1B.

Transceiver 52 may be mounted to printed circuit board 66. Antenna signals associated with antenna 54 may be transmitted and received via ground terminal 86 and positive feed terminal 88. Feed terminal 88 may be connected to pad 68 using microstrip transmission line signal conductor 70. Ground terminal 86 may be electrically connected with ground conductor 82 using conductive via 84. Ground conductor 82 may be, for example, a trace formed from a layer of copper or other conductor on board 66.

Antenna resonating element 54-1B may have first (proximal) end 76 and second (distal) end 80. Second end 80 is typically referred to as the tail of antenna resonating element 54-1B and is preferably located away from the surface of device 10 to avoid proximity effects. For example, second end 80 may be located within the interior of device 10 away from the surfaces of housing 12 (i.e., the conductive surfaces of housing portions 12-1 and the dielectric surfaces of housing portion 12-2B). First end 76 may be electrically connected to contact pad 68 using any suitable contact structure arrangement. With one suitable arrangement, a pogo pin such as pogo pin 78 may be used to form an electrical contact between antenna resonating element end 76 and contact pad 68. This is merely illustrative. If desired, electrical contact may be made between antenna resonating element 54-1B and contact pad 68 using other suitable structures such as a spring or clip. A spring arrangement may be formed, for example, by bending end 76 to form a spring from resonating element 54-1B in the vicinity of contact pad 68.

Antenna resonating element 54-1B may be formed from a strip of metal (as an example). Antenna resonating element 54-1B may be a free-standing structure, a trace that is patterned on the surface of a substrate such as a flex circuit, or may be attached to other suitable mounting structures. With one illustrative arrangement, which is sometimes described herein as an example, antenna 54 is formed from a strip of metal that is mounted to a dielectric support structure such as support structure 90 (sometimes referred to as a chassis or carrier).

Antenna resonating element dielectric support structure 90 may be formed from plastic or any other suitable dielectric. The effective dielectric constant of the support structure 90 may be decreased by forming air-filled regions within the support structure 90. By forming air-filled openings such as holes and ridges within support structure 90, the dielectric constant of the support structure in the vicinity of antenna resonating element 54-1B is reduced. For a given desired frequency of operation (e.g., 2.4 GHz), a relatively low dielectric constant for support structure 90 is advantageous, because it allows the length of antenna resonating element 54-1B to be increased, thereby improving antenna efficiency. In a typical scenario (e.g., 2.4 GHz operation with a plastic support structure), the length of antenna resonating element 54-1B may be about 2 cm. The length of resonating element 54-1B is generally about 5-30 mm, depending on the communications frequency band for which coverage is desired. The length of antenna resonating element 54-1B is approximately equal to a quarter of a wavelength at its operating frequency.

Figure 10:
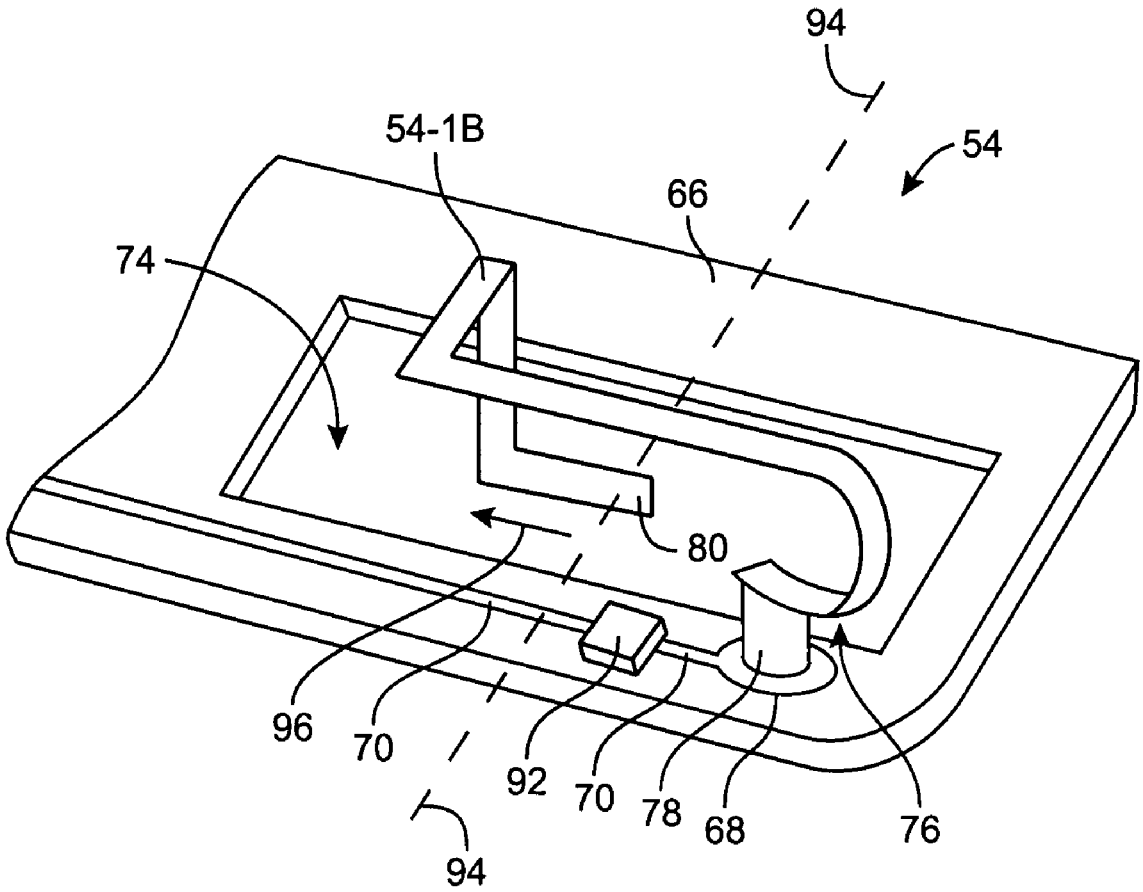
FIG. 10 is a perspective view of a portion of an illustrative antenna in accordance with an embodiment of the present invention shown without a supporting dielectric chassis.

A perspective view of antenna 54 in which dielectric antenna resonating element support structure 90 of FIG. 9 is not present is shown in FIG. 10. As shown in FIG. 10, distal tip 80 of antenna resonating element 54-1B may be located within and adjacent to hole 74 in printed circuit board 66 at a position that is approximately equidistant from the sidewalls of hole 74. In this location, end 80 is also approximately equidistant from the nearby edges of conductive housing walls 12-1 and conductive bezel 14.

Antenna efficiency and bandwidth is improved by ensuring that end 80 (and antenna resonating element 54-1B) is not too close to conductive structures such as bezel 14 and housing walls 12-1. Accordingly, antenna resonating element 54-1B may have a number of bends that help to position end 80 in a suitable location. As shown in FIG. 9, a length of antenna resonating element 54-1B such as portion 81 may extend parallel to the walls of housing 12 (i.e., the front and rear surfaces of housing 12 in the present example). Portion 83 extends parallel to portion 81. Portions such as portions 85 and 87 extend at right angles to portions 81 and 83. Portion 85 extends upwards from the antenna ground plane, perpendicular to portions 83 and 81. Portion 87 extends downwards towards the ground plane, perpendicular to portions 81 and 83. Bend 89 (which may be a single bend or a compound bend formed of two or more individual bends) ensures that the distal end of antenna resonating element 54-1B is located within the interior of housing 12 away from housing surfaces such as the front and rear housing surfaces of device 10.

Figure 11:
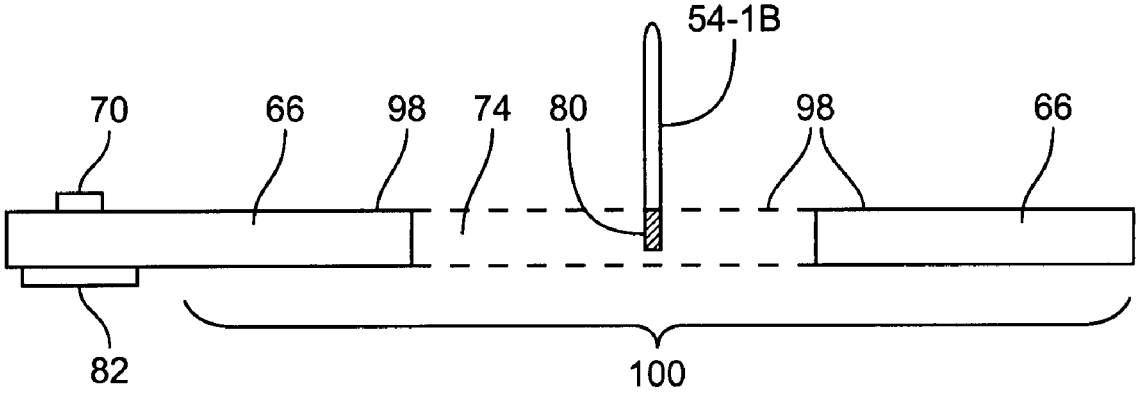
FIG. 11 is a cross-sectional view of an illustrative antenna resonating element and printed circuit board structure associated with an antenna in accordance with an embodiment of the present invention.

A cross-sectional view of antenna 54 that is taken along dotted line 94 of FIG. 10 in direction 96 is shown in FIG. 11. As shown in FIG. 11, end 80 of antenna resonating element 54-1B may, if desired, lie below upper surface 98 of printed circuit board 66 within hole 74. Printed circuit board 66 may be a multilevel circuit board (e.g., a circuit board that supports 2-8 levels of metal). To ensure that antenna resonating element 54-1B is not adversely affected by conductive materials in its vicinity, the conductive layers of printed circuit board 66 may be patterned so that there is no metal adjacent to hole 74 such as in region 100.

To ensure adequate impedance matching between transceiver 52 and antenna 54, the path between transceiver 52 and antenna 54 may contain an impedance matching network such as optional impedance matching network 92 of FIG. 10. Any suitable circuitry may be used for impedance matching network 92. Illustrative examples of suitable impedance matching networks are shown in FIGS. 12, 13, 14, and 15.

Figure 12:
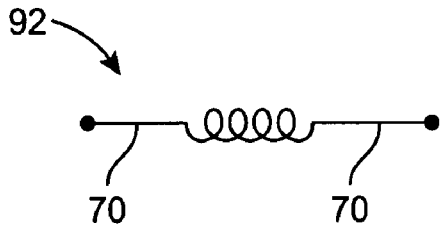
FIGS. 12, 13, 14, and 15 are circuit diagrams of illustrative antenna impedance matching networks that may be used for an antenna in a handheld electronic device in accordance with embodiments of the present invention.
Figure 13:
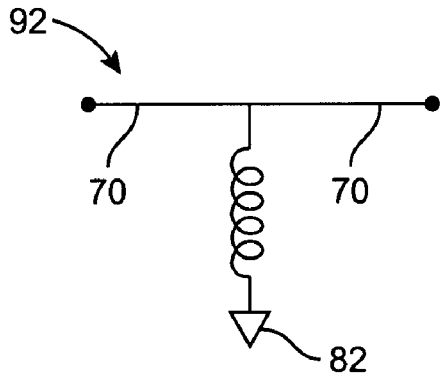
Figure 14:
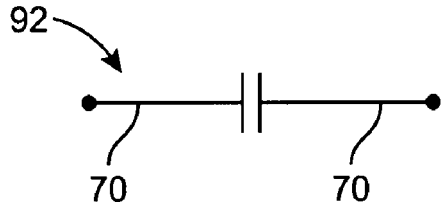
Figure 15:
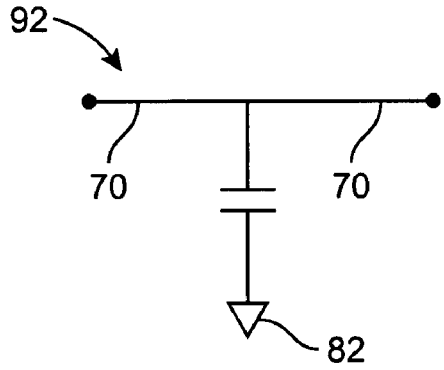

In the example of FIG. 12, impedance matching network 92 is formed from an inductor that is connected in series along signal path 70. Impedance matching network 92 of FIG. 13, which may be preferred, contains an inductor such as a 1.1 nH inductor that is shunted to ground. Impedance matching network 92 of FIG. 14 has a capacitor connected in series in path 70 between transceiver 52 and contact pad 68. In the arrangement of FIG. 15, impedance matching network 92 contains a capacitor that forms a shunting signal path between signal line 70 and ground.

Figure 16:
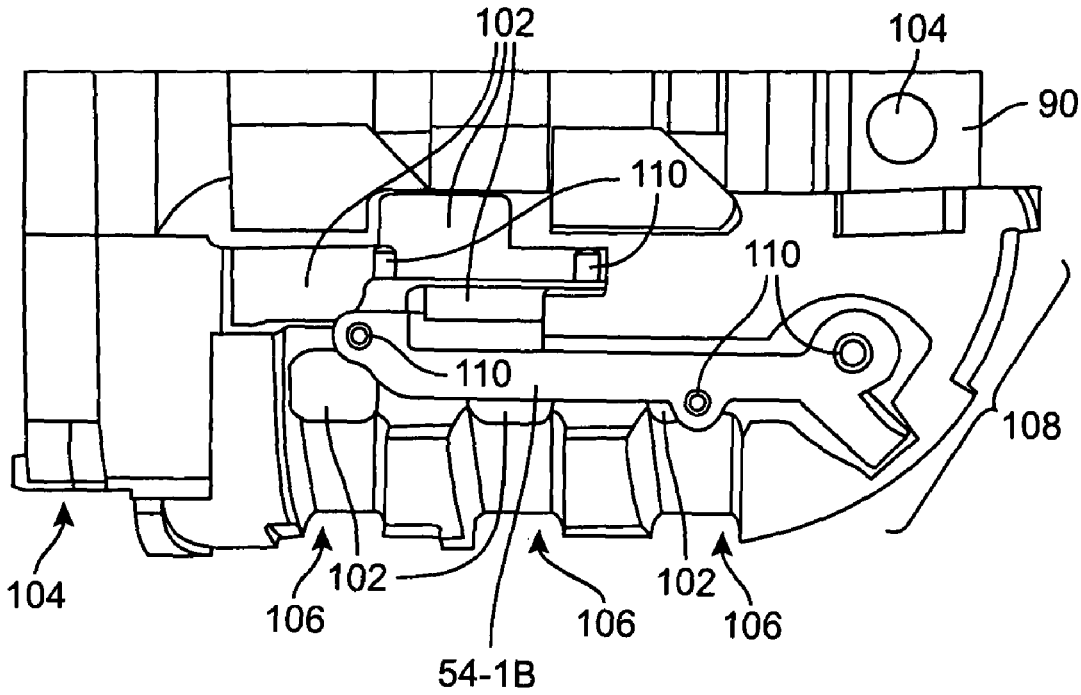
FIG. 16 is a top view of an antenna chassis and antenna resonating element for an antenna in a handheld electronic device in accordance with the present invention.

FIG. 16 shows a top view of an illustrative embodiment of dielectric antenna resonating element support structure 90 and antenna resonating element 54-1B. As shown in FIG. 16, dielectric antenna resonating element support structure 90 may have cut-away air-filled regions 102 (holes) that help to reduce the effective dielectric constant of the dielectric antenna resonating element support structure. Dielectric antenna resonating element support structure 90 may also have cut-away air-filled regions such as air-filled channels 106. Dielectric antenna resonating element support structure 90 may be formed from ABS plastic or other suitable dielectric materials. The dielectric constant of the ABS plastic or other dielectric materials may be approximately 2.8 to 3.0. The dielectric constant of air is 1.0. By configuring dielectric resonating element support structure 90 to form air-filled openings such as holes 102 and 106, the effective dielectric constant for the antenna resonating element may be reduced to a value that is below 2.8 to 3.0. It may be advantageous when at least some of the air-filled holes in support 90 are immediately adjacent to antenna resonating element 54-1B, as shown in FIG. 16. Reductions in the dielectric constant for support 90 allow the length of antenna resonating element 54-1B and therefore the efficiency of the antenna to be increased.

Dielectric antenna resonating element support structure 90 may have screw holes such as holes 104. Such holes may be used to attach dielectric antenna resonating element support structure 90 to housing 12 (e.g., with screws, plastic posts, or other fasteners). Dielectric posts (e.g., plastic posts formed from part of antenna resonating element support structure 90) such as posts 110 may mate with matching holes in antenna resonating element 54-1B. During assembly, posts 110 and the corresponding holes in antenna resonating element 54-1B may help to align antenna resonating element 54-1B properly with respect to antenna resonating element support structure 90 and may help to attach antenna resonating element 54-1B to antenna resonating element support structure 90. If desired, the tips of posts 110 may be enlarged slightly (e.g., using heat treatment) to hold antenna resonating element 54-1B in place.

Edge 108 of antenna resonating element support structure 90 may be curved (as an example). This may help antenna resonating element support structure 90 to conform to the curved corners of housing 12. Dielectric cap 12-2B (FIGS. 4A and 4B) may be used to cover dielectric antenna resonating element support structure 90 and antenna resonating element 54-1B when mounted in housing 12.

Figure 17:
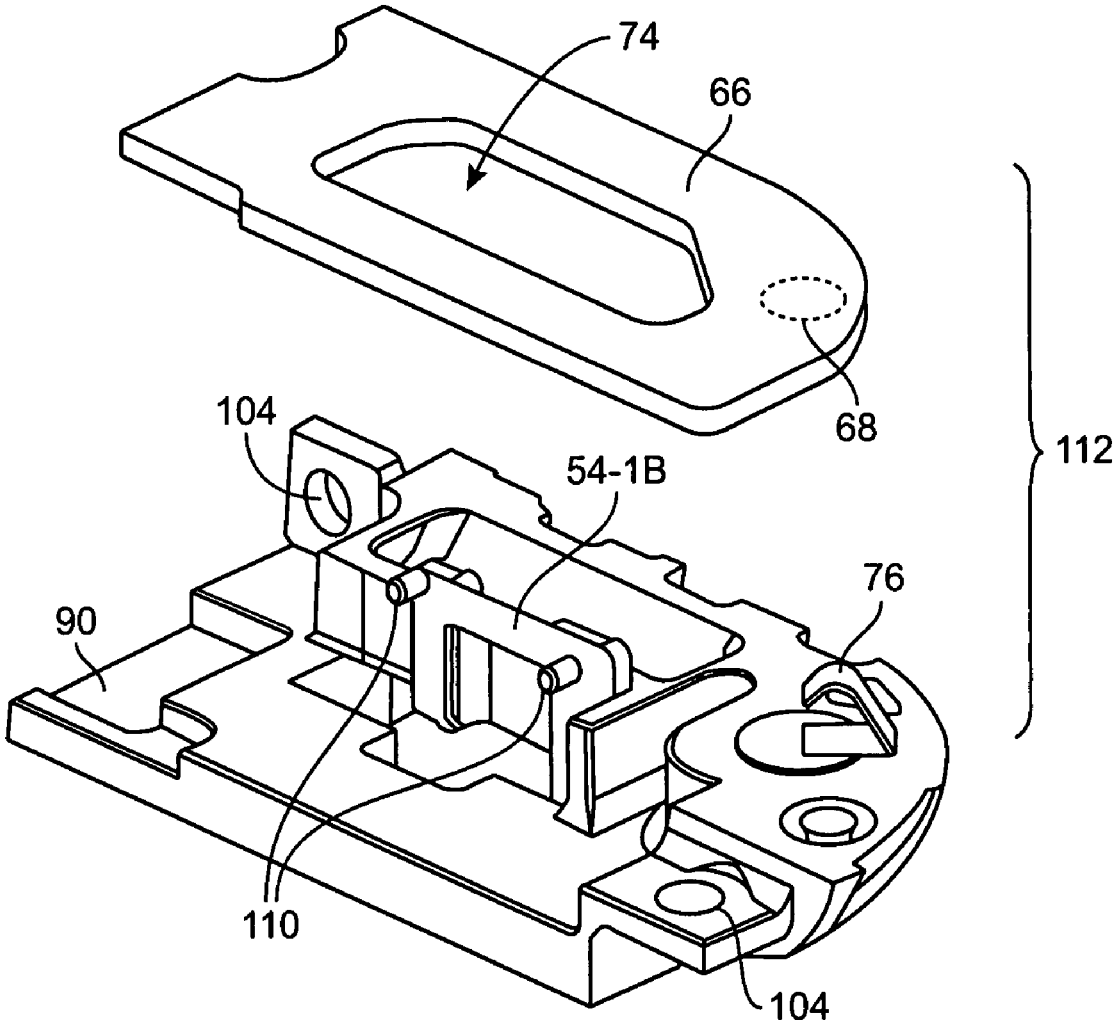
FIG. 17 is an exploded perspective view of an illustrative antenna chassis and antenna resonating element for an antenna in a handheld electronic device in accordance with an embodiment of the present invention.
Figure 18:
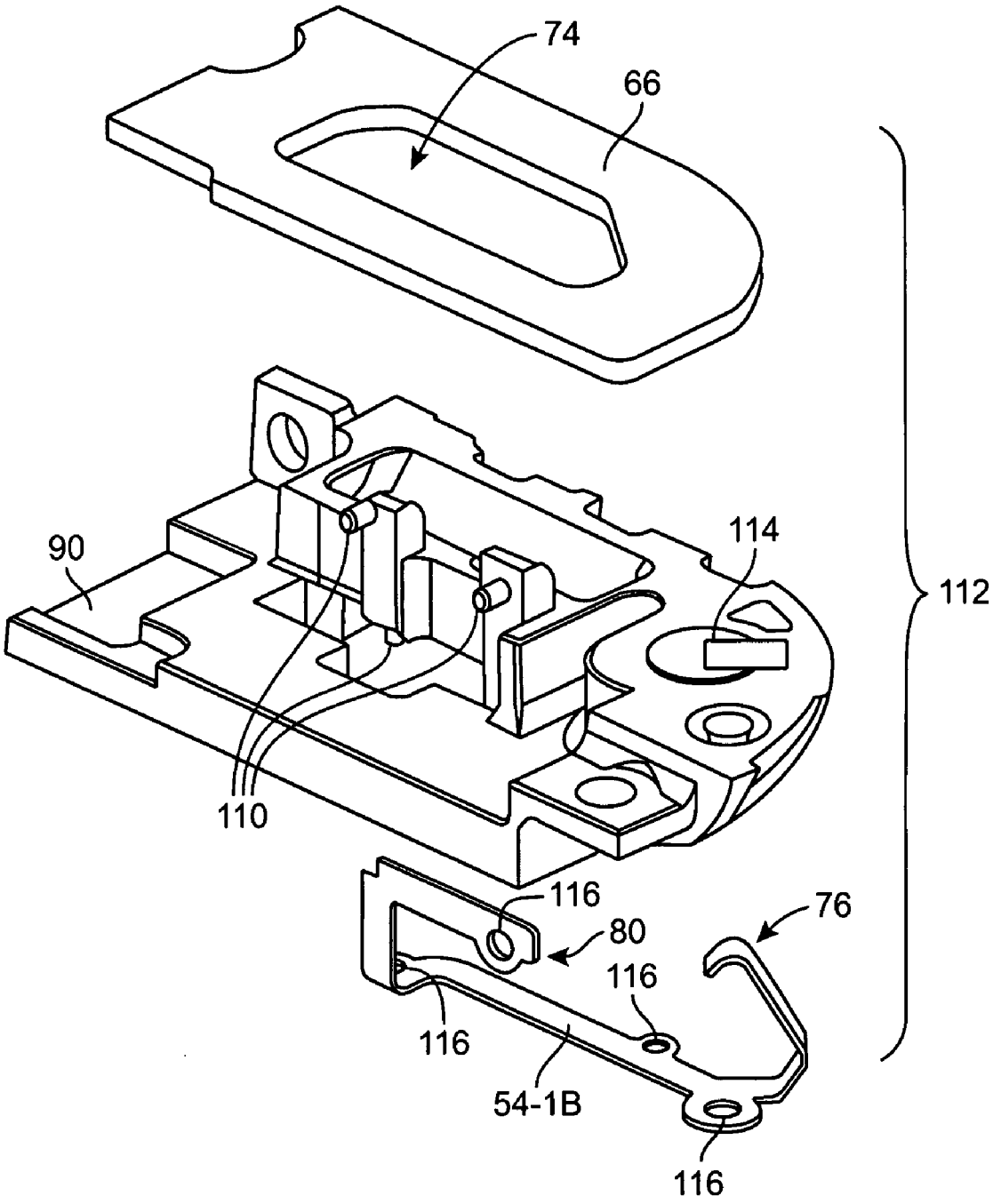
FIG. 18 is an exploded perspective view of an illustrative printed circuit board portion, an antenna chassis, and an antenna resonating element for an antenna in a handheld electronic device in accordance with an embodiment of the present invention.

When assembled in device 10, dielectric antenna resonating element support structure 90 may mate with printed circuit board 66 to form an assembly such as assembly 112 in the exploded perspective view of FIG. 17. End 76 of antenna resonating element 54-1B may be bent to form a spring or clip, as shown in FIG. 17. The spring that is formed in this way may be biased against contact pad 68 when dielectric antenna resonating element support structure 90 is mounted to printed circuit board 66. If desired, a pogo pin (i.e., a spring-loaded pin that reciprocates within a pin housing) or other suitable electrical contact structure may be formed at end 76 in place of the illustrative spring structure that is shown in FIG. 17. FIG. 18 is an exploded perspective view of assembly 112 of FIG. 17 showing an illustrative shape for antenna resonating element 54-1B in more detail. As shown in FIG. 18, dielectric antenna resonating element support structure 90 may have a hole 114 or other opening through which end 76 of antenna resonating element 54-1B passes during assembly. Holes 116 in antenna resonating element 54-1B may mate with posts 110 or other suitable registration structures on antenna resonating element support structure 90.

As shown in FIG. 18, antenna resonating element 54-1B may be formed from a strip of conductor. The thickness (smallest lateral dimension) of the conductor may be, for example, 0.05 mm to 1 mm. The width (the second smallest lateral dimension) of the strip of conductor may be, for example, 0.5 mm to 5 mm. The length of the strip of conductor may be, for example, 5 mm to 30 mm.

The foregoing is merely illustrative of the principles of this invention and various modifications can be made by those skilled in the art without departing from the scope and spirit of the invention.

What is claimed is:

1. A handheld electronic device antenna in a handheld electronic device having housing surfaces and a dielectric housing portion in a corner of the handheld electronic device, comprising:

a ground plane antenna element;

a strip antenna resonating element, wherein the strip antenna resonating element has a proximal end that is fed by a transmission line and a distal end that is located at an interior location within the handheld electronic device away from the housing surfaces and under the dielectric housing portion in the corner of the handheld electronic device, wherein the strip antenna resonating element has a first portion at the proximal end that extends upwards from the ground plane antenna element, wherein the strip antenna resonating element has a second portion at the distal end that extends downwards towards the ground plane antenna element, wherein the strip antenna resonating element has at least one right-angle bend between the proximal and distal ends, and wherein the first and second portions are parallel to each other, and wherein the strip antenna resonating element is not grounded along its length; and at least one printed circuit board that surrounds an air-filled hole in which at least a portion of the strip antenna resonating element is located, wherein the at least one printed circuit board has top and bottom surfaces and wherein the at least one printed circuit board does not have any metal on the top and bottom surfaces in contact with a perimeter of the air-filled hole.

2. The handheld electronic device antenna defined in claim 1 further comprising a dielectric antenna resonating element support structure to which the strip antenna resonating element is mounted.

3. The handheld electronic device antenna defined in claim 1 further comprising a dielectric antenna resonating element support structure to which the strip antenna resonating element is mounted, wherein the dielectric antenna resonating element support structure comprises an air-filled hole adjacent to the strip antenna resonating element.

4. The handheld electronic device antenna defined in claim 1 further comprising a dielectric antenna resonating element support structure to which the strip antenna resonating element is mounted, wherein the strip antenna resonating element comprises holes and wherein the dielectric antenna resonating element support structure comprises posts that extend through the holes in the strip antenna resonating element.

5. The handheld electronic device antenna defined in claim 1 wherein the proximal end of the strip antenna resonating element comprises a bent spring portion.

6. The handheld electronic device antenna defined in claim 1 wherein the distal end of the strip antenna resonating element has a third portion that extends parallel to at least one of the housing surfaces.

7. The handheld electronic device antenna defined in claim 1 further comprising a contact pad to which the proximal end of the strip antenna resonating element is connected, wherein the strip antenna resonating element comprises a plurality of bends.

8. A handheld electronic device that has a front and a rear and that is operated in a portrait orientation and, when rotated counterclockwise, a landscape orientation, comprising:

a conductive housing having at least one substantially rectangular conductive housing surface, wherein the rectangular conductive housing surface has an opening, wherein the opening is located in an upper-right corner of the conductive housing surface when the handheld electronic device is viewed from its front operating in its portrait orientation;

transceiver and control circuitry mounted within the conductive housing;

at least one antenna, wherein the antenna comprises a ground plane element and an antenna resonating element and wherein the antenna resonating element is mounted within the opening in the upper-right corner of the conductive housing;

a dielectric cap that covers the antenna resonating element; and at least one printed circuit board that surrounds an air-filled hole in which at least a portion of the antenna resonating element is located, wherein the at least one printed circuit board has top and bottom surfaces and wherein the at least one printed circuit board does not have any metal on the top and bottom surfaces in contact with a perimeter of the air-filled hole.

9. The handheld electronic device defined in claim 8 further comprising a display that displays images in the portrait orientation when the handheld electronic device is operating in the portrait orientation and that displays images in the landscape orientation when the handheld electronic device is operating in the landscape orientation, wherein the dielectric cap comprises portions that lie flush with the rectangular conductive housing surface.

10. The handheld electronic device defined in claim 8, wherein the at least one printed circuit board has a transmission line conductor, wherein the antenna resonating element includes a conductive strip having a first end and a second end, wherein the first end is electrically connected to the transmission line conductor on the printed circuit board, and wherein the second end is located adjacent to the hole, the handheld electronic device further comprising:

a conductive bezel that extends around at least part of the hole.

11. The handheld electronic device defined in claim 8 further comprising:

a transmission line located on the at least one printed circuit board, wherein the transmission line has a signal conductor and a ground conductor; and a contact pad that is located on the printed circuit board and that is connected to the signal conductor, wherein the transceiver and control circuitry are electrically connected to the transmission line, wherein the antenna resonating element is electrically connected to the contact pad.

12. The handheld electronic device defined in claim 8 further comprising:

a transmission line located on the at least one printed circuit board, wherein the transmission line has a signal conductor and a ground conductor, wherein the transceiver and control circuitry is electrically connected to the transmission line, wherein the antenna resonating element has a first end and a second end and a plurality of bends between the first end and the second end, wherein the first end of the antenna resonating element is electrically connected to the transmission line, and wherein the second end of the antenna resonating element is located in the air-filled hole.

13. The handheld electronic device defined in claim 8 further comprising:

a transmission line located on the printed circuit board, wherein the transmission line has a signal conductor and a ground conductor, wherein the transceiver and control circuitry is electrically connected to the transmission line, wherein the antenna resonating element has a first end and a second end, wherein the first end of the antenna resonating element is electrically connected to the transmission line, wherein the second end of the antenna resonating element is located within the air-filled hole, and wherein the antenna resonating element comprises a strip antenna resonating element; and a dielectric antenna resonating element support structure to which the strip antenna resonating element is mounted.

14. The handheld electronic device defined in claim 8 further comprising:

a transmission line located on the at least one printed circuit board, wherein the transmission line has a signal conductor and a ground conductor, wherein the transceiver and control circuitry is electrically connected to the transmission line, wherein the antenna resonating element has a first end and a second end, wherein the first end of the antenna resonating element is electrically connected to the transmission line, wherein the second end of the antenna resonating element is located within the air-filled hole, and wherein the antenna resonating element comprises a strip antenna resonating element; and a dielectric antenna resonating element support structure to which the strip antenna resonating element is mounted, wherein the dielectric antenna resonating element support structure contains at least one air-filled hole adjacent to the strip antenna resonating element.

15. The handheld electronic device defined in claim 8 further comprising an additional antenna resonating element, wherein the rectangular conductive housing surface has an additional opening, wherein the additional opening is located at a lower end of the conductive housing surface when the handheld electronic device is viewed from its front operating in its portrait orientation, and wherein the additional antenna resonating element is mounted within the handheld electronic device within the additional opening.

16. A handheld electronic device, comprising:

a housing having housing surfaces including a conductive rear surface and having a display mounted to at least part of a front surface;

a dielectric housing portion formed in an opening within a corner of the conductive rear surface;

at least one printed circuit board having a hole;

a transceiver circuit mounted to the at least one printed circuit board;

a transmission line connected to the transceiver circuit;

an antenna mounted within the housing, wherein the antenna comprises:

a ground plane; and an antenna resonating element formed from a strip of conductor that is located adjacent to the dielectric housing portion, wherein at least a portion of the dielectric housing portion lies flush with the conductive rear surface of the housing, wherein the antenna resonating element has a plurality of bends and has first and second ends, wherein the first end of the antenna resonating element is coupled to the transmission line adjacent to the at least one printed circuit board, wherein the bends in the antenna resonating element route the strip of conductor so that the second end of the antenna resonating element is not adjacent to the surfaces of the housing, wherein the antenna resonating element has a first portion at the first end that extends upwards from the ground plane, wherein the antenna resonating element has a second portion at the second end that extends downwards towards the ground plane, wherein the plurality of bends includes at least one right-angle bend between the first and second ends, wherein the first and second portions are parallel to each other, wherein the antenna resonating element is not grounded along its length, wherein at least a portion of the antenna resonating element is located in the hole of the at least one printed circuit board, wherein the at least one printed circuit board has top and bottom surfaces, and wherein the at least one printed circuit board does not have any metal on the top and bottom surfaces in contact with a perimeter of the hole.

17. The handheld electronic device defined in claim 16 further comprising a dielectric antenna resonating element support structure to which the strip of conductor is attached, wherein the strip of conductor comprises a first portion that is parallel to at least one of the housing surfaces and a second portion that is perpendicular to the first portion and wherein the dielectric antenna resonating element support structure comprises portions defining at least one hole adjacent to the strip of conductor.

18. The handheld electronic device defined in claim 16 wherein the transceiver circuit is configured to transmit and receive signals through the antenna in a 2.4 GHz communications band, the handheld electronic device further comprising an impedance matching network coupled in the transmission line between the transceiver circuit and the antenna.

* * * * *